United States Patent [19]

Henmi et al.

[11] 3,989,557

[45] Nov. 2, 1976

[54] PROCESS OF PRODUCING SEMI-HARD MAGNETIC MATERIALS

[75] Inventors: Zenzo Henmi; Tatsuji Sasaki, both of Kawasaki; Makoto Kassai; Masanori Okada, both of Yokohama, all of Japan

[73] Assignee: Fujitsu Ltd., Japan

[22] Filed: July 3, 1975

[21] Appl. No.: 593,031

Related U.S. Application Data

[63] Continuation-in-part of Ser. No. 511,370, Oct. 2, 1974, abandoned, which is a continuation-in-part of Ser. No. 279,320, Aug. 10, 1972, abandoned.

[30] Foreign Application Priority Data

June 1, 1972 Japan ..... 47-53814

[52] U.S. Cl. ..... 148/120; 148/31.55; 148/121; 75/170

[51] Int. Cl.[2] ..... H01F 1/00

[58] Field of Search ..... 148/120, 121, 31.55; 75/170

[56] References Cited

UNITED STATES PATENTS 3,390,443 7/1968 Gould et al. ..... 148/31.55

3,600,162 8/1971 Kaplan et al. ..... 148/31.55

3,617,260 11/1971 Detert ..... 75/170

*Primary Examiner*—Walter R. Satterfield

*Attorney, Agent, or Firm*—Nelson E. Kimmelman; Allan Ratner; Paul Maleson

[57] ABSTRACT

Semi-hard magnetic materials exhibiting an excellent square hysteresis loop are prepared by the following steps. An alloy material consisting essentially, by weight, of 73–93% Co, 1–5%Nb and the balance Fe is subjected to process annealing at not lower than 900° C and cold working at a reduction of area of not less than 75% and then is subjected to any combination treatment involving one or more stress relief annealings at a temperature in the range 500°–700° C for a short period of time such that no intermetallic compound precipitates in said alloy followed by cooling to the ambient temperature, and one or more ageing treatments of said cooled material at a temperature in the range 600°–900° C for a considerably longer time such that an intermetallic compound does precipitate in said alloy.

8 Claims, 4 Drawing Figures

PROCESS OF PRODUCING SEMI-HARD MAGNETIC MATERIALS

REFERENCE TO RELATED APPLICATIONS

This is a continuation-in-part of our former application Ser. No. 511,370 filed Oct. 2, 1974, now abandoned which was a continuation-in-part of our application Ser. No. 279,320, entitled "Process of Producing Semi-Hard Magnetic Materials," filed Aug. 10, 1972, now abandoned.

The present invention relates to a process for the production of semi-hard magnetic materials, particularly those which are composed of cobalt-niobium-iron alloys and possess the desired square hysteresis loop. These semi-hard materials are, therefore, suitable for use in applications utilizing residual magnetization.

As semi-hard magnetic materials, some cobalt-iron alloys have been heretofore proposed. For example, an alloy consisting of 48% iron, 48% cobalt, 3.5% vanadium and 0.5% manganese, all by weight, was announced under the name of "Remendur" by Western Electric Co., Ltd. U.S.A. (see "Bell Laboratories Record," page 257, June, 1965). A low magnetostriction permanent magnet alloy consisting of 82% cobalt, 12% iron and 6% gold was published in "Journal of Applied Physics," page 1268, February (vol. 39), 1968.

Magnetic properties required for these magnetic materials may vary depending upon their application purposes. When these materials are, for example, used in switching elements and memory elements which have been rapidly developed of late, these should possess an excellent residual magnetization property in order to maintain information. In particular, the semi-hard magnetic materials which are utilized in half-fixed memory devices and channel switches of an electronic switching system should preferably possess the following properties.

1. Both saturation magnetic flux density (Bs) and residual magnetic flux density (Br) are high.

2. The square hysteresis loop exhibits a high squareness ratio (Br/Bs) and a high "fullness factor." The term fullness factor used herein is represented by the formula: $\sqrt{(BH)_{max}/BrHc}$ wherein $(BH)_{max}$ is the maximum magnetic energy product and Hc is coercive force.

3. Coercive force (Hc) is in the range between 10 and 50 0e.

4. Plastic workability is excellent, i.e., these materials are capable of being easily worked into any shaped product such as fine wire rod, sheet, tape and the like.

However, the semi-hard magnetic materials known to the art are unsatisfactory especially in both squareness ratio and fullness factor. Therefore, there is still a considerable demand for the provision of semi-hard magnetic materials possessing an excellent square hysteresis loop.

It is, therefore, an object of the present invention to provide the semi-hard magnetic materials which possess all the properties listed above and are excellent particularly in squareness ratio as well as fullness factor, and therefore suitable for use as materials for magnetic devices utilizing the residual magnetization.

In accordance with the present invention, there is provided a process of producing semi-hard magnetic materials which comprises the steps of:

1. subjecting an alloy material consisting essentially, by weight, of 73 to 93% cobalt, 1 to 5% niobium and the balance iron to process annealing at a temperature of not less than 900° C;

2. cold working at a reduction of area of not less than 75%, and thereafter;

3. subjecting the resulting alloy to any combination treatment involving (a) one or more annealings at 500''–700° C for a short time so that no intermetallic compound precipitates in the alloy followed by cooling to ambient temperature, and (b) one or more agings under conditions such that an intermetallic compound precipitates in the alloy.

Figure 1:
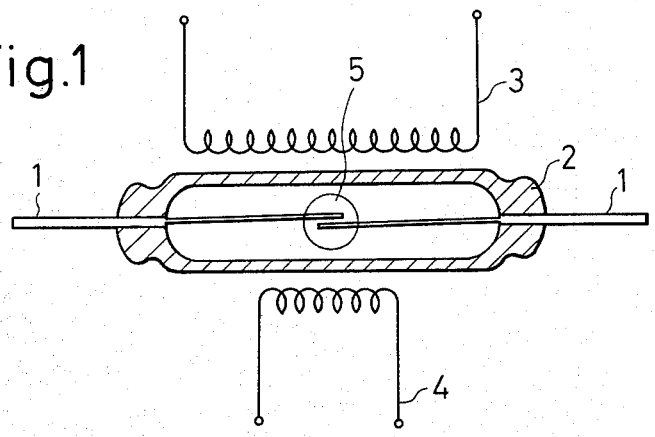
FIG. 1 is a schematic diagram of a magnetic device in which the present invention may be used.

The characteristics required for the semi-hard magnetic materials used in magnetic devices utilizing the residual magnetization will be illustrated in more detail with reference to FIG. 1 in the accompanying drawings.

As one example of the magnetic devices, a reed switch is shown which comprises two pieces of a semi-hard magnetic wire 1 sealed in a glass tube 2. A contact 5 is formed in the glass tube 2. Coils 3 and 4 are wound around the outside of the glass tube 2 in order to change the residual magnetization condition of the semi-hard magnetic wire 1. When the coil 3 is supplied with sufficient current to saturate the magnetic wire 1, the two contact points of contact 5 facing each other attract each other to close the contact 5. In this case, if the residual magnetic flux of the magnetic wire 1 is high, the attractive force of the magnetic wire 1 due to the residual magnetic flux overcomes the elastic restoring force of the magnetic wire 1, thereby maintaining the contact 5 closed. Therefore, in order to release the contact 5, it is necessary to supply an electric current to the coil 4 in the direction such that the residual magnetic flux of the magnetic wire 1 decreases. In such a reed switch device, in order to enhance the magnetic attractive force at the contact 5, the higher the magnetic flux density of the material of which the contact 5 is composed, the more advantageous. Further, in order to enhance the stability of the contact holding in the contact 5, it is required that both the squareness ratio and the fullness factor exhibited in the square hysteresis loop of the material should be high. The coercive force of the contact material should preferably be high with a view toward operational margin in the switching drive, but low with a view toward ease of operation. Obviously, the optimum coercive force of the contact varies depending upon various factors in designing the reed switch.

In addition, since the magnetic wires of the reed switch are sealed in the glass tube in a state of air-tightness the following prerequisites should be preferably satisfied. First, that the adhesion between both materials of the magnetic wires and the glass is good. Second, that both thermal expansion coefficients are substantially equal to each other. Third, that even after the magnetic wires are heated to a high temperature to seal them in the glass tube, the magnetic wires exhibit a high squareness ratio and a high magnetic flux density, and an appropriate coercive force.

The semi-hard magnetic materials obtained by the process of the present invention are characterized as exhibiting: high squareness ratio, fullness factor and magnetic flux density; an appropriate coercive force, excellent adhesion to glass and an appropriate thermal expansion coefficient. These magnetic properties do not change even at a high temperature. Further, these materials are superior in plastic workability, i.e., capable of being easily worked into any shaped product such as fine wire rod by wire drawing, and sheet or tape by rolling or hammering.

The alloy materials used in the process of the present invention are those which consist essentially, by weight, of

| | | |
|---|---|---|
| (a) | 73 to 93% | cobalt, |
| (b) | 1 to 5% | niobium, and |
| (c) | balance | iron. |

The alloy materials may contain a trace amount of impurities incorporated during the production process. Also, these may contain a deoxidizer or desulfurizer such as manganese, magnesium, calcium, aluminum or silicon in an amount required for accomplishing its purpose. Further, the alloy materials may contain a limited amount of one or more metals which result in an intermetallic compound with cobalt or iron when subjected to an ageing treatment, as niobium does, without interfering with any objects of the present invention. These metals include, for example, tantalum, titanium, vanadium, zirconium, molybdenum, chromium, tungsten and the like. The amount of these metals used in addition to niobium is usually such that the ratio by weight of these metals to niobium is below 30/70. When the ratio is higher than 30/70, the coercive force of the alloy is not improved as much as in the case of only niobium being used.

If the content of cobalt in the alloy material used in the process of the present invention is in excess of 93% by weight, part of the face-centered cubic lattice of the crystal lattice transforms into a hexagonal closed-packed lattice, resulting in reduction of the plastic workability. In contrast, if the content of cobalt is below 73% by weight, part of the face-centered cubic lattice is transformed into a body-centered cubic lattice by cold working, also resulting in reduction of the plastic workability.

The presence of niobium in the alloy material exerts a great effect on an increase in coercive force of the alloy. However, if the content of niobium is in excess of 5% by weight, the magnetic flux density of the resulting alloy decreases and the workability thereof greatly deteriorates. In contrast, if the content of niobium is below 1% by weight, the effect of increasing the coercive force is too small to be practical.

In accordance with the present invention, the cobalt-niobium-iron alloy material set forth above is first subjected to process annealing at a temperature of not less than 900° C not longer than 10 minutes converting it wholly into a solid solution. The temperature of process annealing greatly affects the coercive force of the alloy.

That is, the temperature of not lower than 900° C enhances the coercive force conjointly with the subsequent cold working and ageing.

After the above process annealing the alloy material so treated is subjected to cold working at a reduction of area of not less than 75%. The cold working is an essential process for enhancing the coercive force when subjected to the subsequent ageing. In particular, in order to enhance the axial squareness ratio and the fullness factor of a wire material, the wire material should be subjected to cold working at a reduction of area of not less than 75%. This produces a strong fibrous structure, the axial direction of which coincides with the direction of 111.

Then the cold-worked alloy is subjected to a combination treatment including at least one stress relief step at a temperature of 500°–700° C for not longer than 30 minutes so no intermetallic compound is precipitated and cooling to ambient temperature.

The alloy material is also subjected to at least one ageing step to precipitate an intermetallic compound crystal between niobium and cobalt, or niobium and iron, which results in enhancement of the coercive force. The aging treatment is carried out under the conditions such that the crystal of a cobalt-niobium, or niobium-iron, intermetallic compound precipitates. These conditions preferably include temperatures of 600° to 900° C for at least one half hour. For example, with reference to the alloy wire material having a diameter of 0.5 mm, the ageing treatment is carried out at a temperature of 700° to 750° C for approximately one hour to produce the maximum coercive force. When the temperature of aging is below 700° C., it requires a longer time than 1 hour to obtain the coercive force approaching the maximum value. In contrast, when the temperature of aging is higher than 750° C it is possible to obtain the coercive force approaching the maximum value with a shorter time than one hour. Therefore, without change of content of niobium in the alloy material, it is possible to obtain the desirable coercive force within the range of the maximum value to approximately 10 Oe by suitably combining the temperature and the period of aging.

Effects of the temperature of process annealing and the temperature of ageing on the coercive force will be illustrated with reference to FIG. 2.

Figure 2:
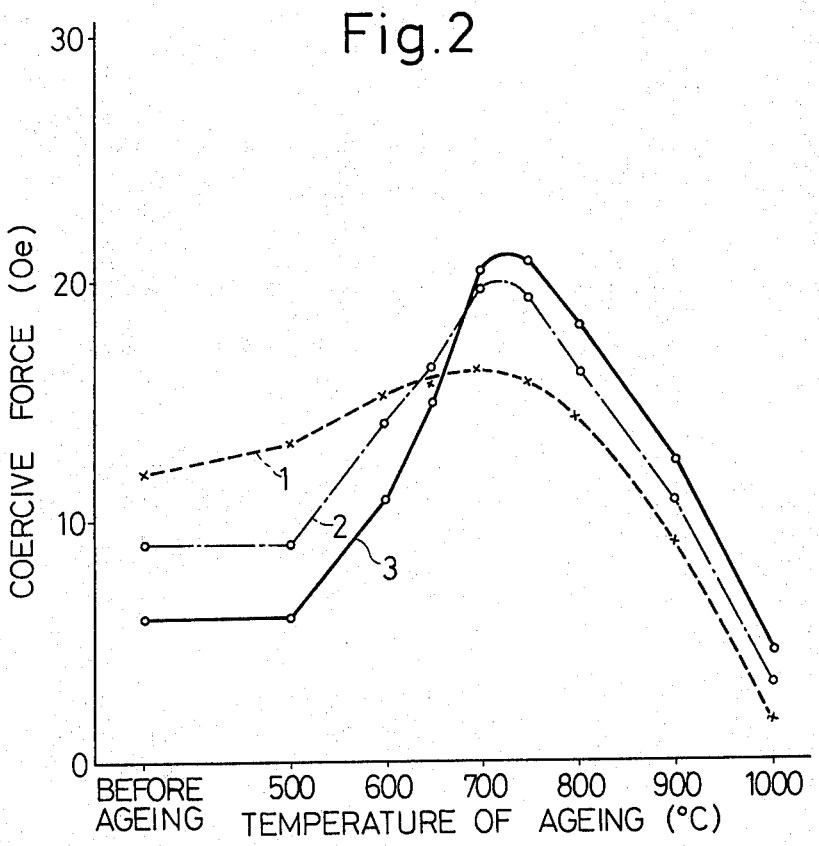
FIG. 2 is a group of curves showing the effects of temperature of process annealing and temperature of aging on coercive force.

FIG. 2 shows the change of the coercive force when the cobalt (85%)-niobium (3%)-iron (12%) alloy materials are subjected to process annealing at temperatures of 900° C. (curve 1), 1000° C (curve 2) and 1,100° C. (curve 3) and then, to aging treatment at temperatures of 500° to 1,000° C. In comparing the curves 1, 2 and 3 with each other, the following will be apparent. When the temperature of ageing is relatively low, i.e., approximately 500° to 600° C., the lower the temperature of process annealing, the higher the coercive force. But, when the temperature of aging is higher than approximately 650° C, the higher the temperature of process annealing, the higher the coercive force, and the coercive force becomes maximum at temperatures of aging ranging from approximately 700° to 750° C. When the temperature of aging is higher than approximately 750° C., the coercive force decreases with an increase of the temperature of aging, but the higher the temperature of process annealing, the higher the coercive force. That is, when the aging treatment is carried out at a temperature higher than approximately 700° C, the higher the temperature or process annealing, the higher the coercive force of the alloy materials.

The alloy material, which has been subjected to process annealing and the subsequent cold-working, is then subjected to both the stress relief annealing set forth below and the aging set forth above. The stress relief annealing and the aging may be combined in any order. Each treatment of stress relief annealing and aging may be carried out one or more times. Further, any other working such as a mechanical working may be inserted during these treatments.

The stress relief annealing is carried out in order to relieve the macroscopic stress of the alloy material occuring due to a mechanical working. The stress relief annealing in the process of the present invention should be carried out under conditions such that no crystal of the niobium-cobalt or niobium-iron intermetallic compound precipitates within the interior of the alloy materials. The stress relief annealing may be carried out at a temperature preferably from 500° to 700° C, most preferably from 600° to 650° C, for not longer than 10 minutes. When the temperature is lower than 500° C, an excessive length of time is required to relieve the macroscopic stress of the alloy material. In contrast, when the temperature is higher than 700° C, the intermetallic compound tends to precipitate. The period for the stress relief annealing varies depending upon the temperature. Usually, the preferable period is 5 to 10 minutes at a temperature of 600° to 650° C and 2 to 3 minutes at a temperature of 700° C.

With this stress relief annealing, the fullness factor in the hysteresis loop of the alloy material is improved and the magnetization in a demagnetizing field is stabilized. Therefore, this annealing has a great effect of making uniform the practical quality of the alloy material. When the stress relief annealing is performed prior to a mechanical working of the alloy material into a practical shape, the mechanical working can be easily performed and some difficulties such as surface torsion occurring due to pressing are removed. Therefore, such annealing prior to a mechanical working reduces the irregularity in shape of the mechanically worked product.

The annealing and aging treatments, which are performed at high temperatures, are preferably carried out in an atmosphere of non-oxidizing gas such as hydrogen, nitrogen or argon, or in vacuum in order to avoid undesirable oxidation.

In accordance with the present invention, the residual magnetic property of the semi-hard material having excellent magnetic properties is enhanced as mentioned hereinbefore. This semi-hard material can be worked into any desired shape or size such as, for example, a fine wire rod having a diameter as small as approximately 0.05 mm and a tape having a thickness as thin as approximately 0.02 mm. Further, these workings can be carried out without any sacrifice of the excellent magnetic properties of the semi-hard material. These finished products are useful as members of a magnetic device utilizing residual magnetization such as, for example, read switches and memories.

The process of the present invention will be illustrated in detail by way of examples.

Metal materials used in the following examples had the purities:

| Metal | Purity (% by weight) |
|---|---|
| Cobalt | 99.6 Co |
| Electrolytic iron | 99.9 Fe |
| Ferroniobium | 66.7 Nb |
| Silicon | 99.99 Si |

EXAMPLE 1

Using the above-listed metal materials, a metal mixture consisting of 85% cobalt, 3% niobium, 0.1% silicon and balance iron, all by weight, was prepared. The mixture was melted at a temperature of 1,600° C in a vacuum melting furnace. The melt was molded into an ingot having a diameter of 20 mm and a weight of approximately 1 kg. The silicon was employed as a deoxidizer. The ingot was subjected to a homogenizing annealing at a temperature of 1,150° C for 5 hours in an atmosphere of hydrogen and then, to a surface cutting. Then, the ingot was subjected to a cold working to form it into a wire rod having a diameter of 2.0 mm while annealings at a temperature of 1,100° C in an atmosphere of hydrogen were suitably inserted. The wire rod so formed was subjected to process annealing at a temperature of 1,100° C for 30 minutes and then, to cold drawing to reduce the diameter to 0.6 mm. Thus, the degree of the cold working was 91% in terms of the reduction of area. The wire so drawn was treated by a straightening machine to correct the bends.

The resultant wire was divided into two equal parts. One half of the wire was subjected to stress relief annealing at a temperature of 650° C for 5 minutes in an atmosphere of hydrogen cooled to a temperature of approximately 25° C and then to aging treatment at a temperature of 700° C for 1 hour in an atmosphere of hydrogen.

For the purpose of comparison, the remaining half of the wire was subjected to aging treatment at a temperature of 700° C for 1 hour without the stress relief annealing.

Figure 3:
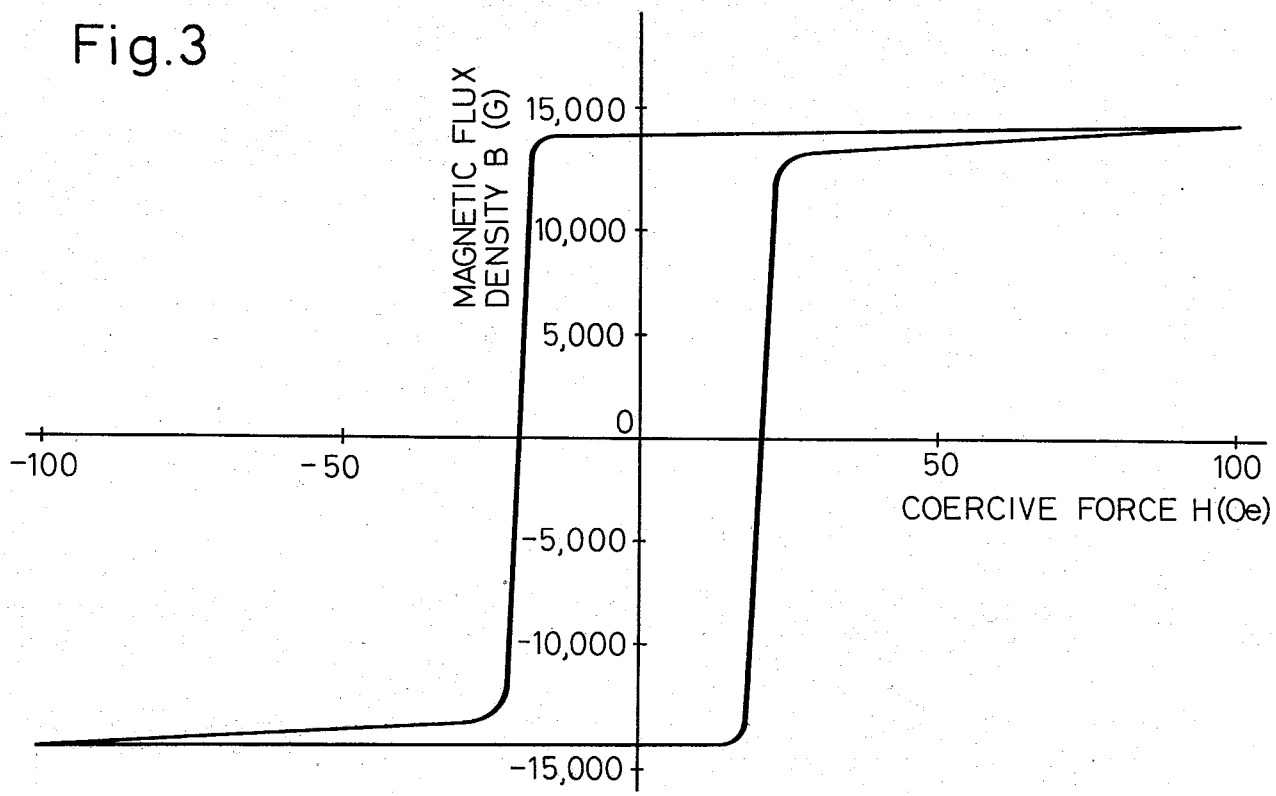
FIG. 3 is a graph showing magnetic flux density as a function of coercive force on part of a wire subjected to stress relief annealing in accordance with the present invention.
Figure 4:
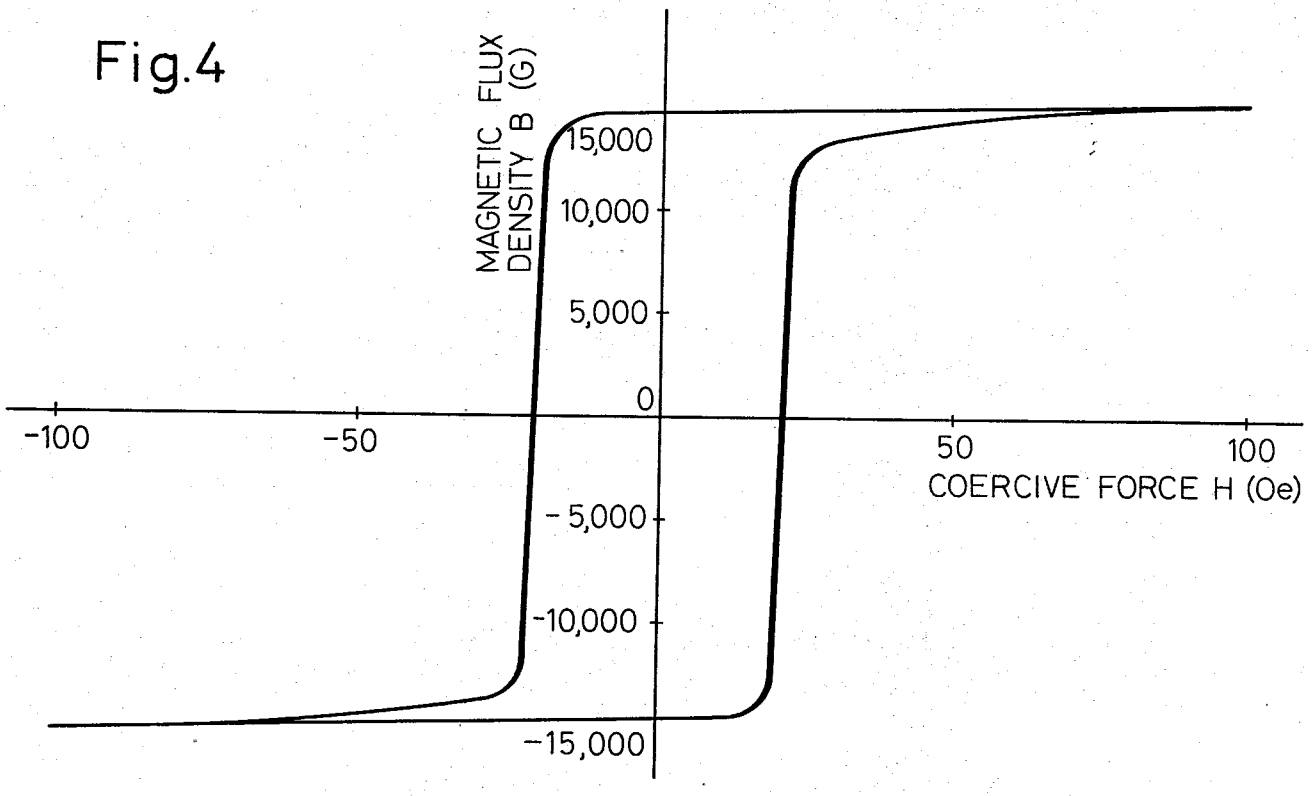
FIG. 4 is a graph showing magnetic flux density plotted as a function of coercive force on another part of the same wire which had not been subjected to stress relief annealing.

The hysteresis loops of the former wire obtained in the above example and the latter wire obtained in the above comparison example are shown in FIGS. 3 and 4, respectively. The direct current magnetic properties of the two wires are shown in Table 1. The hysteresis loops were determined by applying the maximum magnetic field of 100 Oe in the longitudinal direction. From these loops, the magnetic flux density at a magnetic field of 100 Oe ($B_{100}$) the residual magnetic flux density (Br), the squareness ration $Br/B_{100}$ and the fullness factor ($\sqrt{(BH)_{max}/BrHc}$) were calculated.

Table 1

| Sample | Item | Stress relief annealing | Coercive force (Hc), in Oe | Magnetic flux density ($B_{100}$) at 100 Oe, in G |
|---|---|---|---|---|
| Example 1 | | included | 20.2 | 15,600 |
| Comparison example No. 1 | | no | 20.4 | 15,600 |

| Sample | Item | Residual magnetic density (Br), in G | Squareness ratio $Br/B_{100}$ | Fullness factor $\sqrt{\frac{(BH)max}{BrHc}}$ |
|---|---|---|---|---|
| Example 1 | | 15,000 | 0.96 | 0.93 |
| Comparison | | 15,000 | 0.96 | 0.90 |

Table 1-continued example No. 2

It is apparent from FIGS. 3 and 4 and Table I that the coercive force and the magnetic flux density of the wire, which was subjected to stress relief annealing according to the present process, are nearly equal to those of the comparative example involving no stress relief annealing. But, the fullness factor of the example is obviously superior to that of the comparative example.

EXAMPLE 2

A cold drawn wire having a diameter of 0.6 mm was manufactured in the same manner as that in Example 1. The wire was treated by a straightening machine to correct the bends. Then, the wire was subjected to stress relief annealing at a temperature of 650°C for 5 minutes and, thereafter, hammered into a tape having a width of 1.05 mm and a thickness of 0.26 mm. The degree of the cold working at this stage was 91.3% in terms of the reduction of area. This tape was then subjected to an aging treatment at a temperature of 700° C for 1 hour in an atmosphere of hydrogen. The tape so treated exhibited entirely the same hysteresis loop as that shown in FIG. 3.

EXAMPLE 3

A self-hold reed switch of the type shown in FIG. 1 was manufactured from the alloy material obtained by the procedure of Example 1. With reference to FIG. 1, two pieces of semi-hard magnetic wire 1 were manufactured from the wire obtained by the procedure of Example 1. The end portion of each wire was hammered into a flat shape and one surface of the flat end portion was plated with rhodium to form a contact point. The contact points of the two semi-hard magnetic wires 1 were sealed in a glass tube 2 together with non-oxidizing gaseous mixture of nitrogen and hydrogen. Two coils 3 and 4 were wound around the glass tube 2.

When a pulse current sufficient for magnetizing the wire 1 was passed through the coil 3, the contacting points of contact 5 facing each other attracted each other to close the contact 5. Even after the current was shut off, the attractive force due to the residual magnetic flux overcame the elastic restoring force of the magnetic wire 1, and hence the contact 5 was maintained at the state of closure. That is, the magnetic wire 1 had a so-called magnetic self-hold function. The contact 5 was released when an electric current was supplied to the coil in a direction such that the residual magnetic flux of the magnetic wire 1 decreased.

In the manufacture of the reed switch, the alloy material produced by the process of the present invention exhibited a good adhesion to glass and a good electrodeposition capability with noble metals. The alloy material was obviously characterized as having excellent residual magnetic properties.

EXAMPLES 4 – 6

Procedures identical to those in Example 1 were repeated three times using a mixture of 85% cobalt, 3% niobium and the balance iron (Example 4), a mixture of 85% cobalt, 4% niobium and the balance iron (Example 5) and a mixture of 85 % cobalt, 5% niobium and the balance iron.

For the purpose of comparison, the above procedures were repeated using, instead of niobium, 3% vanadium (Comparison Example 2), 4% vanadium (Comparison Example 3) and 5% vanadium (Comparison Example 4).

The resultant semi-hard magnetic materials and comparison materials had the properties as indicated in Table 2.

Table 2

| Ex. No. | | Nb (%) | V (%) | Coercive Force (Hc) in Oe | Magnetic Flux Density (B100) at 100 Oe, in g |
|---|---|---|---|---|---|
| Ex. | 4 | 3 | — | 20 | 15,500 |
| Ex. | 5 | 4 | — | 28 | 14,800 |
| Ex. | 6 | 5 | — | 35 | 14,400 |
| Comparison Ex. | No. 2 | — | 3 | 5 | 14,000 |
| Comparison Ex. | No. 3 | — | 4 | 4.8 | 13,200 |
| Comparison Ex. | No. 4 | — | 5 | 4.7 | 12,700 |

From Table 2, it is evident that the alloy materials containing niobium are remarkably superior in coercive force and magnetic flux density compared to the alloy materials containing vanadium.

EXAMPLE 7

The same procedures as in Example 1 were repeated by using a mixture of 85% by weight of cobalt, 3% by weight of niobium and the balance of iron, and the cold-worked wire rod was divided into 16 equal parts. Each of the parts were stress-relief annealed, cooled to an ambient temperature, and then aged under the conditions indicated in Table 3.

Table 3

| Stress-Relief Annealing Temp. × Time | Ageing Temperature (° C) | Time (min) | Coercive Force (Hc) (Oe) |
|---|---|---|---|
| | 600 | 30 | 12.4 |
| | 700 | 30 | 18.4 |
| | 800 | 30 | 17.1 |
| 700° C × 5 min | 900 | 30 | 11.0 |
| | 600 | 60 | 12.1 |
| | 700 | 60 | 19.4 |
| | 800 | 60 | 16.6 |
| | 900 | 60 | 10.6 |
| | 600 | 30 | 14.7 |
| | 700 | 30 | 18.5 |
| | 800 | 30 | 16.7 |
| 700° C × 10 min | 900 | 30 | 11.4 |
| | 600 | 60 | 15.4 |
| | 700 | 60 | 19.6 |
| | 800 | 60 | 16.6 |
| | 900 | 60 | 10.4 |

EXAMPLES 8 – 11

In Examples 8 through 11, the same procedures as in Example 1 were repeated, except that the stress-relief annealing was carried out at the temperatures and times indicated in Table 4 and the ageing was carried out at a temperature of 700° C for 60 minutes in an atmosphere of hydrogen.

For comparison, in Comparison Examples 5, 6 and 7, the same operations were repeated, except that no stress-relief annealing was effected and the ageing was carried out at the temperature and the time indicated in Table 4.

The resultant materials had the properties indicated in Table 4.

Table 4

| Ex. No. | | Stress-Relief Annealing Temp. (° C) | Stress-Relief Annealing Time (min) | Ageing Temp. (° C) | Ageing Time (min) | HC (Oe) | B100 (Kg) | Br (Kg) | Br/B100 | $\sqrt{\frac{(BH)max}{BrHc}}$ |
|---|---|---|---|---|---|---|---|---|---|---|
| | 8 | 500 | 10 | 700 | 60 | 19.6 | 15.8 | 15.2 | 0.96 | 0.88 |
| Ex. | 9 | 600 | 10 | 700 | 60 | 19.6 | 15.9 | 15.3 | 0.96 | 0.88 |
| | 10 | 650 | 5 | 700 | 60 | 19.6 | 15.9 | 15.2 | 0.96 | 0.88 |
| | 11 | 700 | 5 | 700 | 60 | 19.8 | 15.9 | 15.2 | 0.95 | 0.88 |
| Comparison | 5 | — | — | 700 | 60 | 19.5 | 15.9 | 15.3 | 0.96 | 0.85 |
| Ex. | 6 | — | — | 700 | 90 | 20.1 | 15.9 | 15.3 | 0.96 | 0.85 |
| | 7 | — | — | 700 | 120 | 20.5 | 15.9 | 15.1 | 0.95 | 0.84 |

Table 4 shows that the fullness factors of the wire in Examples 8 through 11 are larger than those in Comparison Examples 5 through 7 in which no stress-relief annealing was effected.

Table 4 also shows that in the event that no stress-relief annealing is applied to the wire, the resultant wire has a relatively low fullness factor even if the aging is carried out for a long time, for example, 60 through 120 minutes.

From the above examples, it is obvious that the stress-relief annealing separated from the aging step by the cooling step is effective for improving the fullness factor of the semi-hard magnetic material.

We claim:

1. A process of producing semi-hard magnetic materials having square hysteresis loop characteristics which comprises the steps of:

process annealing an alloy material consisting, by weight, of 73 to 93% cobalt, 1 to 5% niobium and the balance consisting essentially of iron, at a temperature of not lower than 900° C, cold working said annealed alloy material at a reduction in area of not less than 75%; and thereafter subjecting said cold worked alloy material to a combination treatment including one or more stress-relief annealings at a temperature of 500° to 700° C for a period of time not longer than 10 minutes selected so that no intermetallic compound precipitates in said alloy material, and one or more additional aging steps at a temperature of 600° to 900° C for a period of time not shorter than 30 minutes selected so that an intermetallic compound precipitates in said alloy material.

2. The process according to claim 1 wherein said stress-relief annealed alloy is cooled to substantially ambient temperature.

3. A process according to claim 1 wherein said process annealing, said stress-relief annealing and said aging treatment are carried out in an atmosphere of non-oxidizing gas or in vacuum.

4. The process according to claim 1 wherein said stress-relief annealing is performed at a temperature within the range 600° to 650° C.

5. The process according to claim 3 wherein said stress-relief annealing is performed at a temperature within said range for a period of 5–10 minutes.

6. The process according to claim 1 wherein said stress-relief annealing is performed at a temperature of about 700° C for a period of time within the range 2–3 minutes.

7. The process according to claim 1 wherein said ageing step is performed at a temperature within the range 600° to 699° C during a period of time in excess of 1 hour.

8. The process according to claim 1 wherein said aging step is performed at a temperature within the range 751° to 900° C for a period of time less than 1 hour.

* * * * *